US006179669B1

(12) United States Patent
Chiang

(10) Patent No.: US 6,179,669 B1
(45) Date of Patent: Jan. 30, 2001

(54) MOLDED RECEPTACLE FOR A DAISY CHAIN POWER CORD ASSEMBLY

(76) Inventor: Thomas Shiaw-Cherng Chiang, Chung-Yang Hsinchun, Hsintien, Taipei (TW)

( * ) Notice: Under 35 U.S.C. 154(b), the term of this patent shall be extended for 0 days.

(21) Appl. No.: 09/351,154

(22) Filed: Jul. 12, 1999

(51) Int. Cl.[7] ..... H01R 13/10

(52) U.S. Cl. ..... 439/682; 439/650; 439/651; 439/652

(58) Field of Search ..... 439/650, 651, 439/654, 682, 685, 686, 502, 505, 584, 585, 210, 211, 107

(56) References Cited

U.S. PATENT DOCUMENTS

| | | | | |
|---|---|---|---|---|
| 3,699,504 | * | 10/1972 | Huber | 339/177 |
| 4,043,630 | | 8/1977 | Suverison et al. | 339/218 M |
| 4,073,564 | * | 2/1978 | Davis, Jr. | 339/157 |
| 4,398,785 | | 8/1983 | Hedrick | 436/695 |
| 4,405,194 | | 9/1983 | van Lierop | 339/147 P |
| 4,684,191 | | 8/1987 | Feher et al. | 439/246 |
| 4,775,332 | | 10/1988 | Bowden, Jr. et al. | 439/650 |
| 4,897,052 | | 1/1990 | Priest et al. | 439/652 |
| 5,137,474 | | 8/1992 | Lin | 439/650 |
| 5,171,168 | | 12/1992 | Chiodo | 439/651 |
| 5,236,374 | * | 8/1993 | Leonard et al. | 439/505 |
| 5,378,161 | | 1/1995 | Loder | 439/177 |
| 5,486,121 | | 1/1996 | Miller | 439/652 |
| 5,560,981 | | 10/1996 | Ito | 428/209 |
| 5,616,041 | | 4/1997 | Brown | 439/222 |
| 5,655,925 | | 8/1997 | Pon | 439/395 |

* cited by examiner

*Primary Examiner*—Paula Bradley
*Assistant Examiner*—Alexander Gilman
(74) *Attorney, Agent, or Firm*—Tipton L. Randall

(57) ABSTRACT

Disclosure is a molded female receptacle for receiving a male plug. The receptacle includes a pair of a female connector member of electrical conductor material with each connector member including a first end with an insertion slot and a second end with crimping means for attachment to conductor wires. A generally rectangular body member of molded insulating material encases the first and second female connector members that are attached in parallel to a two-wire conductor. The molded body member has first and second ends and four sides, with the body member first end having a pair of rectangular apertures, each in register with an insertion slot of a female connector member embedded within the body member. The two-wire conductor extends from two opposite sides of the generally rectangular molded body member near the second end thereof. The first and second ends of the molded body member may be oriented at 180, 135 or 90 degrees relative to each other.

The invention also includes a daisy chain power cord assembly that includes a two-wire conductor with a male plug at one end and a plurality of molded female receptacle assemblies electrically connected in parallel to the conductor at selected spaced intervals.

19 Claims, 9 Drawing Sheets

MOLDED RECEPTACLE FOR A DAISY CHAIN POWER CORD ASSEMBLY

FIELD OF THE INVENTION

The invention relates to an electrical receptacle and, more particularly, to a molded female electrical receptacle suitable for use in a daisy chain power cord assembly.

BACKGROUND OF THE INVENTION

Electrical receptacles are common devices fastened to an end of an electrical conductor wire to allow connection with another electrical conductor wire that is fitted with an electrical plug. The receptacle contains a plurality of apertures, each of which access one conductor strand of the conductor wire. Each conductor wire is fastened to some type of coupling connector that is held within the receptacle at each aperture. The plug contains a like number of blades, each of which is fastened to one conductor strand of the other conductor wire. Inserting the plug blades into the receptacle apertures, and the coupling connectors therein, connects the conductor strands of the two conductor wires, thereby making an electrical connection.

Many receptacles and plugs are produced separately and then fastened by hand to each conductor wire to provide suitable electrical connection for the conductor wires. A more permanent connector system employs molding of an electrically insulating plastic or rubber receptacle or plug directly on the end of a conductor wire. The coupling connectors or plug blades are first fastened to each strand of the conductor wire, and then the outer covering is formed over the wire with blades or the coupling connector fastened thereto. Injection molding of the receptacle or plug end coverings of wires employs a molten thermoplastic material injected into a mold containing the appropriate wires with the appropriate connector end fastened thereto. The production of a receptacle generally employs some type of pin, positioned at each coupling connector, to form the aperture that later accepts the plug blade. After the thermoplastic material sets or cools, the mold and pins are removed, releasing the resulting receptacle or plug end of the wire.

It is some times desirable to provide a power cord with one plug end and multiple female receptacles connected along the length of the cord at selected spaced intervals. This configuration is commonly called a daisy chain power cord. The necessity of having a two-wire conductor both entering and exiting a molded female receptacle results in a congested space around each receptacle of the assembly. Some examples of inventions concerned with electrical receptacles and plugs have been granted patents.

Suverison et al., in U.S. Pat. No. 4,043,630, disclose a molded plug connection including a preformed insert shown in detail in FIGS. 2–6. The insert has a front plate with four spaced apertures which each align with one of four spaced channels in the elongated turret.

U.S. Pat. No. 4,398,785 by Hedrick shows an inner body that is injection-molded about the contacts and the connectors, which are attached to the contacts. Thereafter, an outer cover is injection-molded about the inner body.

In U.S. Pat. No. 4,405,194, van Lierop describes a premolded insert arrangement including a base holding a space connector pin. The base has a recess for receiving a fuse holder. The cap prevents liquid plastic from flowing into the fuse recess during injection molding of the plug body.

Feher et al., in U.S. Pat. No. 4,684,191, describe an electrical connector assembly having contact springs with an outward flare. A fork has tines defining a flared receptacle guiding mouth for receiving a bus bar.

Bowden, Jr. et al., in U.S. Pat. No. 4,775,332, disclose an electrical receptacle having terminals with a pair of grasping members to receive an electrical plug blade. The grasping members taper toward the open end and then flare outwardly.

In U.S. Pat. No. 4,897,052, Priest et al. describe an intermediate electrical component including a two-piece plastic insulating shell having a molded body portion for receiving a plurality of terminal elements and a molded cap portion for enclosing the terminal partially within the body portion and the cap portion. The cap portion is slidably inter-fitted with the body portion. Conductor wires are fastened to power blades, each with a blade section and a pair of resilient leaves, with the leaves adapted to receive another blade. The blades are fitted into the two piece insulating shell and the unit is covered with suitable insulating material by injection molding.

U.S. Pat. No. 5,137,474 by Lin discloses an AC electrical socket structure having conductive strips with U-shaped insertion folds held in place by mounting brackets. The folds are for receiving electrical plug blades.

Chiodo, in U.S. Pat. No. 5,171,168, describes an electrical "piggyback" plug made with a pair of unitary prong-socket members (FIGS. 1–4) having flat socket fingers and a gap there between for receiving a plug blade. The prongs and sockets of the plug are oriented at a 90-degree angle in the molded dielectric plastic body.

U.S. Pat. No. 5,378,161 by Loder shows an electrical connector with tapered male and female surfaces for use with a ribbon cable. The male connector has one conductor, and the female connector has several conductors.

Miller, in U.S. Pat. No. 5,486,121, discloses an electrical connector assembly with a socket subassembly and a distribution assembly. The socket assembly has socket busses with slits for receiving blades of electrical plugs.

In U.S. Pat. No. 5,560,981, Ito describes a double molded connector including a connector portion and an inside-outside communication portion which folds on itself to retain conductor strands in channels. The connector portion and inserted conductor strands of FIG. 7 are molded with insulating resin to produce a finished double molded connector of FIGS. 8 and 9.

Brown et al., in U.S. Pat. No. 5,616,041, discloses a female connector for a plastic molded receptacle. The female connector has a first arm and a second arm with a slot between them. A third arm and a fourth arm are perpendicular to the first and second arms and have a slot between them also. A crimping end secures the conductor wire to the female connector. The first slot includes chamfers at the rounded end, while the third and fourth arms have bent away ends. The slots each can accept a blade from an electrical plug. Two female connectors are employed in a molded receptacle shown in FIGS. 12–15.

In U.S. Pat. No. 5,655,925, Pon describes a female plug that includes an insulating base bracket, two symmetrical contact blades fastened to the base block, an insulating housing covering the block to hold the blades in place, and a two-line electrical wire inserted though a flange rear port on the housing and connected to the contact blades. The base block has a pair of rectangular holes that accept a pair of blades from a male plug, the plug blades contacting the contact blades of the female plug.

Thus, there is an unmet need for an electrical receptacle that can be produced by injection molding techniques and incorporated into a daisy chain power cord assembly without producing a congested area around each receptacle.

SUMMARY OF THE INVENTION

The invention outlined in the disclosure is a female receptacle for receiving a male plug. The receptacle includes a pair of a female connector member of electrical conductor material with each connector member including a first end with an insertion slot and a second end with crimping means for attachment to a conductor wire of the two-wire conductor. A generally rectangular body member of insulating material encases the first and second female connector members that are attached to a two-wire conductor. The body member has first and second ends and four sides, with the body member first end having a pair of rectangular apertures, each in register with an insertion slot of a female connector member embedded within said body member. The two-wire conductor extends from at least one side of the generally rectangular body member near the second end thereof The first and second ends of the body member may be oriented at 180, 135 or 90 degrees relative to each other.

The invention also includes a daisy chain power cord assembly that includes a two-wire conductor with an electrical connection means at one end and a plurality of female receptacle assemblies electrically connected in parallel to the conductor at selected spaced intervals.

DESCRIPTION OF THE PREFERRED EMBODIMENTS

Nomenclature

10 Female Connector Member
12 U-Shaped Section of Connector Member
14 First End of U-Shaped Section
16 Second End of U-Shaped Section
17 Insertion Slot of Connector Member
18 Transverse Bottom Section of U-Shaped Section
20 Flanged Vertical Sides of First End
22 Linear Section of Connector Member
24 First Pair of Crimping Arm Members
26 Second Pair of Crimping Arm Members
28 Conductor Wire Member
30 Insulated Covering of Conductor Wire
32 Two-Wire Insulated Conductor
50 Molded Female Electrical Receptacle Assembly
52 Molded Body Member
54 First End of Molded Body Member
56 Second End of Molded Body Member
58 Sides of Molded Body Member
60 Strengthening Flange of Molded Body Member
62 Rectangular Apertures in First End of Molded Body Member
64 Inwardly Tapering Sides of Rectangular Apertures
66 Power Cord Assembly
68 Connection Means of Cord Assembly
70 Daisy Chain Power Cord Assembly Construction The female receptacle assembly of the present invention includes a pair of female connector members 10, each electrically connected to one conductor wire of a two-wire conductor. The connector members 10 are encased in a body member having a pair of apertures in register with each conductor member. The two-wire conductor extends from two opposite sides of the body member. The female connector member 10 may be of various constructions, but will be described as a specific embodiment shown in FIG. 1. Various other constructions for the female connector 10 may be employed without departing from the scope of the present invention.

Figure 1:
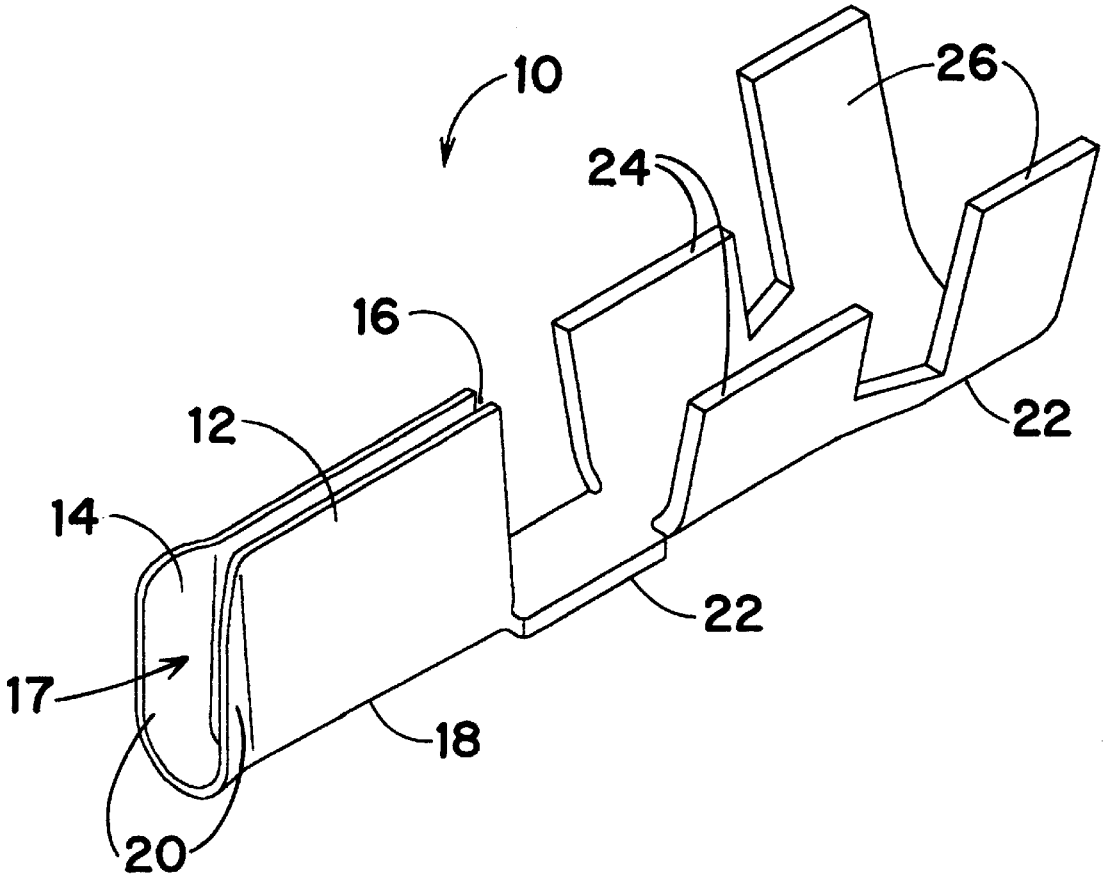
FIG. 1 is an elevational perspective view of a typical female connector member.

Referring to FIG. 1, one embodiment of the female connector member 10 of the present invention is shown. The connector member 10 is made of an electrically conductive material such as copper, brass or ferrous based alloy. The connector member 10 has a U-shaped section 12 with a first end 14 and a second end 16 and a transverse bottom section 18. The U-shaped section first end 14 has vertical sides 20 that are flanged outwardly to enlarge the connector member first end 14 to more readily accept an electrical blade from a male plug. The U-shaped section 12 constitutes an insertion slot 17 for the plug blade. A connector linear section 22 extends from the traverse bottom section 18 of the second end 16 of the U-shaped section 12. The linear section 22 has a first pair of crimping arm members 24 positioned adjacent the U-shaped section 12, and a second pair of crimping arm members 26 positioned opposite the U-shaped section 12 and at the end of the connector member 10. Both crimping arm pairs 24, 26 are co-linear with the connector U-shaped section 12. The crimping arm pairs 24, 26 are used to securely attach one or more insulated electrical conductor wire to the female connector member 10. The first pair of crimping arm members 24 is sized to accept and crimp upon two diameters of a bare conductor wire member 28. The second pair of crimping arm members 26 is sized to accept and crimp upon two diameters of a conductor wire member 28 with an insulation covering 30. Consequently, the first pair of crimping arm members 24 are smaller than the second pair of crimping arm members 26. The linear section 22 and crimping arm member pairs 24, 26 constitute a crimping means at the second end of the female connector member 10. The attachment of two conductor wires 28, one each from two separate two-wire conductors 32 to one female connector member 10, and a similar attachment for a second female connector member 10, is a most convenient method to produce a parallel circuit receptacle assembly 50 which can be connected to additional receptacle assemblies 50 to produce a daisy chain power cord.

Figure 2:
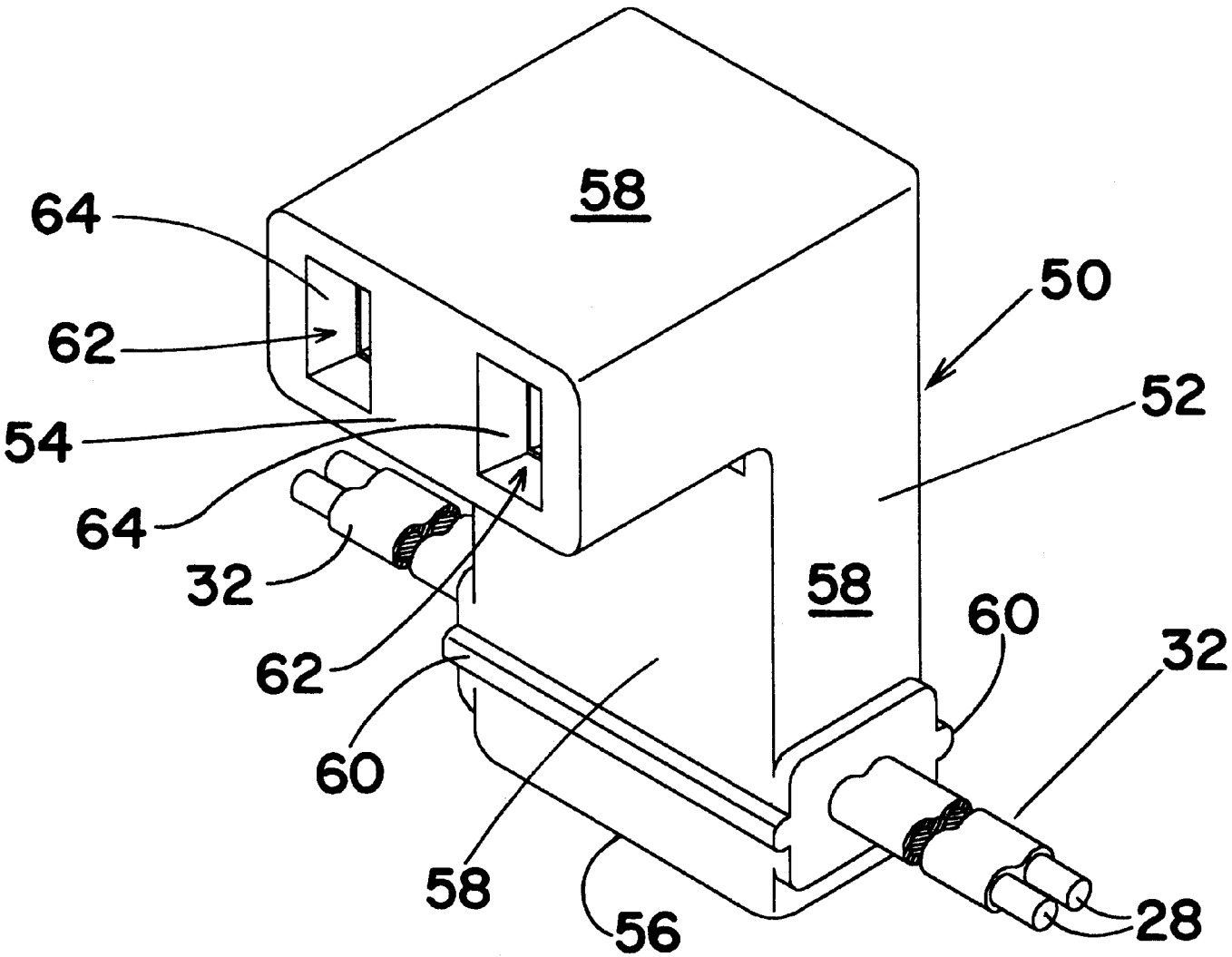
FIG. 2 is an elevational perspective view of one embodiment of the electrical receptacle assembly of the present invention.
Figure 5:
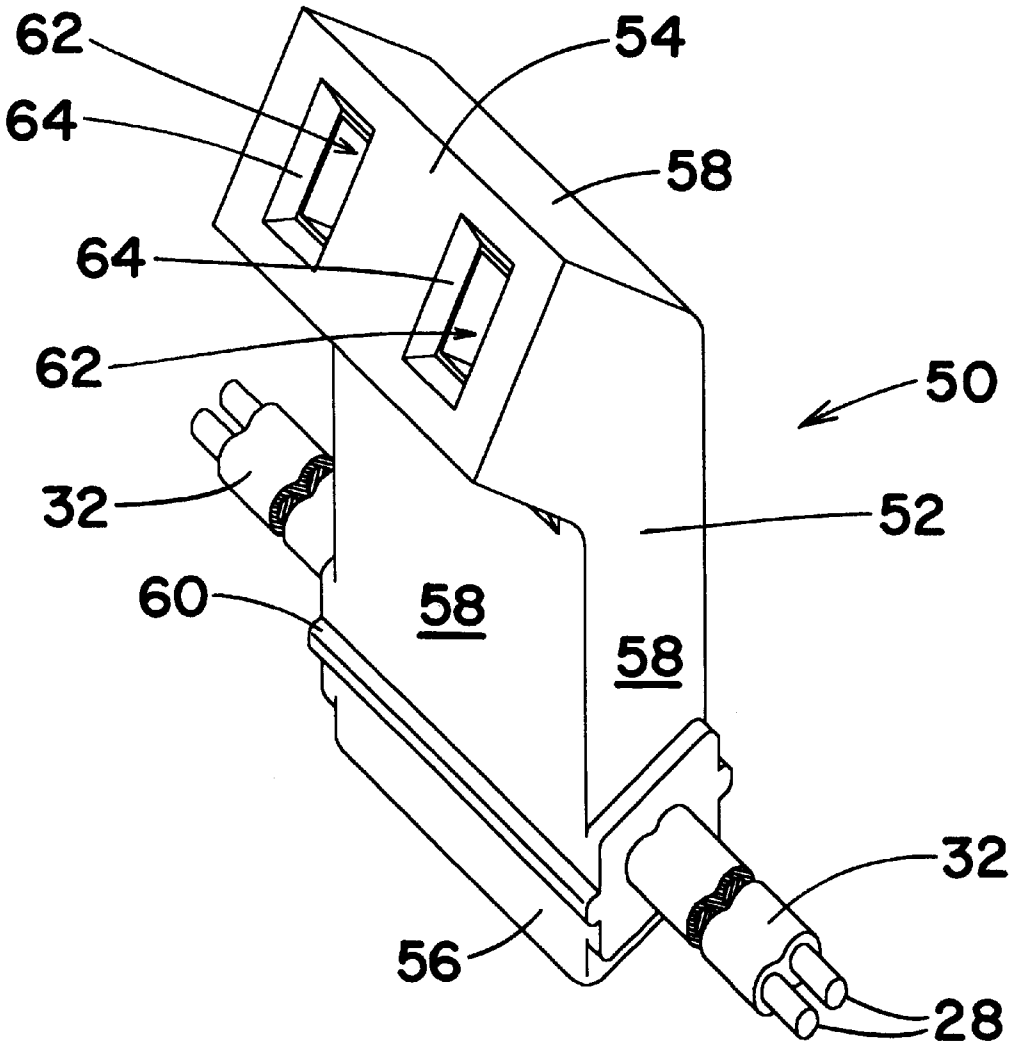
FIG. 5 is an elevational perspective view of another embodiment of the electrical receptacle assembly of the present invention.
Figure 6:
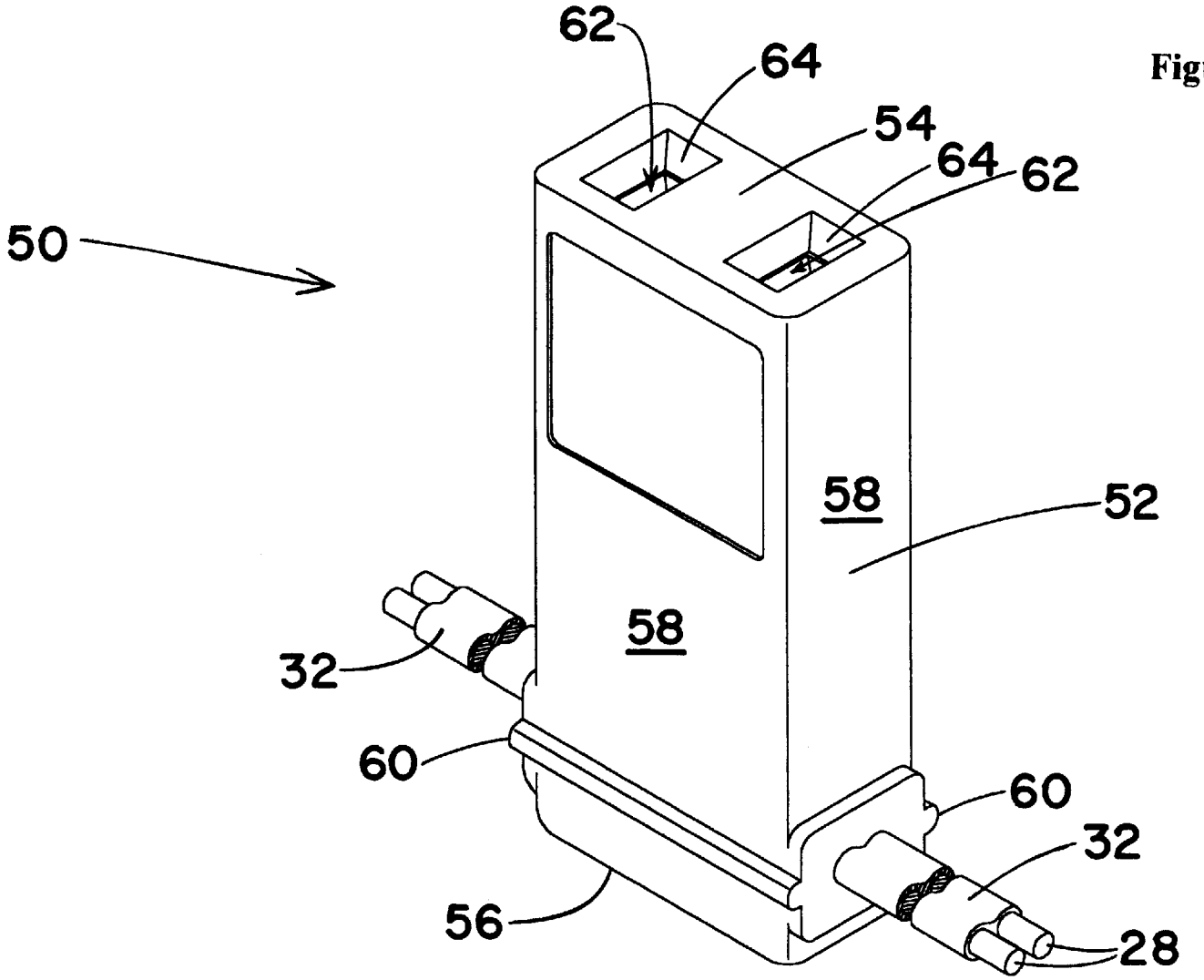
FIG. 6 is an elevational perspective view of another embodiment of the electrical receptacle assembly of the present invention.

One embodiment of the female electrical receptacle assembly 50 suitable for use in a daisy chain power cord assembly is shown in FIG. 2. The receptacle assembly 50 includes a generally rectangular body member 52 having a first end 54 and a second end 56, and four sides 58. The first end 56 and second end 58 may be mutually oriented at a 90 degree angle as shown in FIG. 2, producing an L-shaped body member 52. In alternative embodiments of the invention, the first end 56 and second end 58 may be mutually oriented at a 135 degree angle as shown in FIG. 5, or the first end 56 and second end 58 may be mutually oriented at a 180 degree angle as shown in FIG. 6. The latter orientation produces a linear body member 52. In all embodiments of the receptacle invention, the two-wire conductor 32 extends from opposite sides of the generally rectangular body member 52, for connection to additional receptacle assemblies 50. This configuration requires the minimum amount of two-wire conductor 32 to connect receptacles 50 a given distance apart.

The body 52 of the female receptacle assembly 50 is preferably fabricated by injection molding using a thermoplastic insulating material to encase the pair of female connector member 10. Alternative fabrication techniques for the receptacle assembly body 52 include mechanical assembly of pre-molded sections, or ultrasonic welding of pre-molded sections, with all fabrication techniques enclosing the pair of female connector members 10 and insulated conductor wire 32 attached thereto. The present invention is described for a receptacle assembly 50 with the insulating body member 52 formed by injection molding. It is understood that alternative fabrication techniques are contemplated for the body member 52 with equivalent results obtained.

Figures 3A, 3B, 3C:
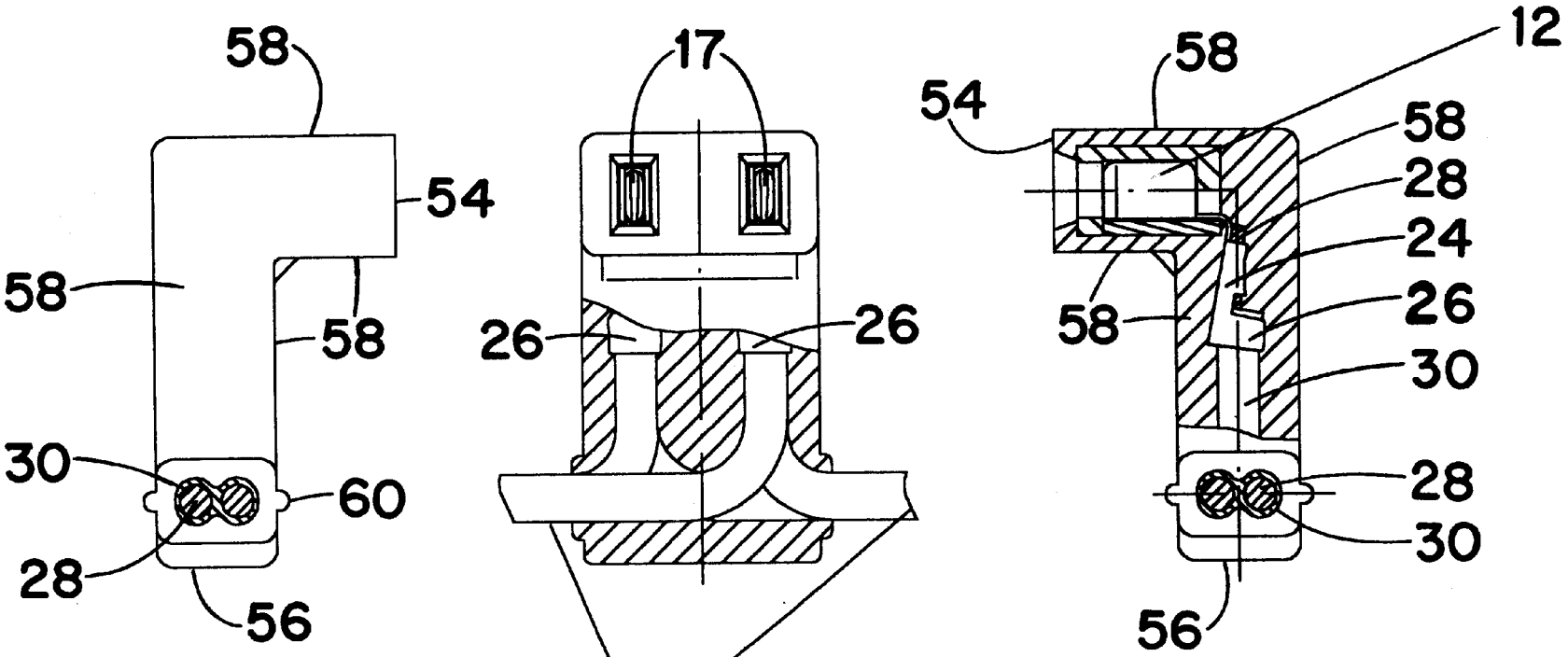
FIG. 3*a* is a plan side view of the embodiment of the electrical assembly of FIG. 2.
FIG. 3*b* is a partial cut away plan view of the embodiment of the electrical receptacle assembly of FIG. 2.
FIG. 3*c* is another partial cut away plan view of the embodiment of the electrical receptacle assembly of FIG. 2.
Figure 4:
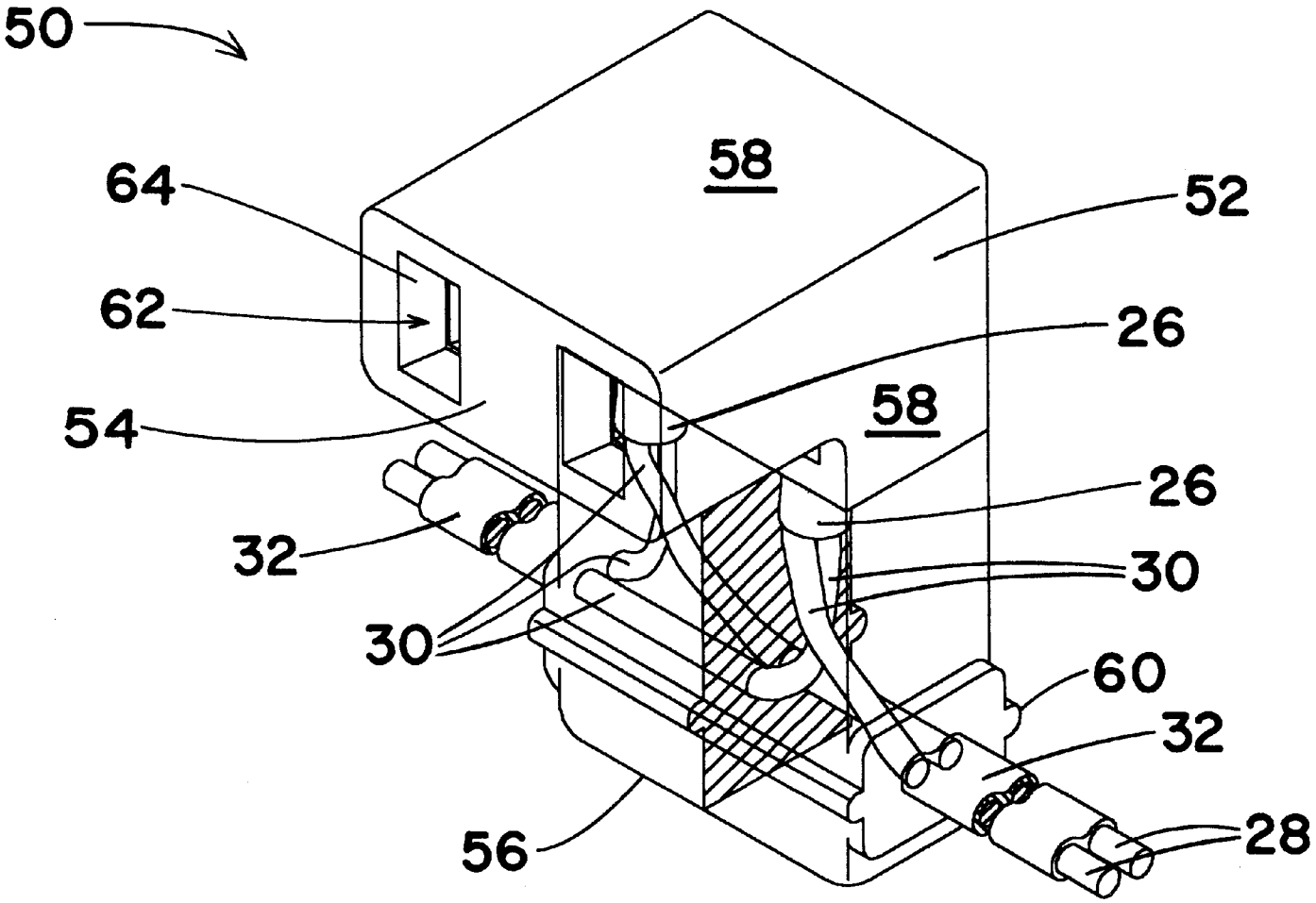
FIG. 4 is a partial cut away elevational perspective view of the electrical receptacle assembly of FIG. 2.

To form a molded female electrical receptacle assembly 50, the two-wire insulated conductor 32 is cut and a single conductor wire 28 from each two-wire conductor end is fastened to one of a pair of female connector members 10 by means of the pairs of crimping arm members 24, 26 on each connector 10. The embodiment of the receptacle assembly 50 shown in FIG. 2, with first end 54 and second end 56 oriented at 90 degrees, requires that the connector member 10 be bent at a point between the U-shaped section 12 and the pairs of crimping arm members 24, 26. The connectors 10 and attached conductor wires 30 are encased within a molded insulating body member body 52, with the two-wire insulated conductor wires 32 extending from two opposite sides 58 of the generally rectangular molded body member 52. A partial cut away view of the receptacle assembly 50 is shown in FIGS. 3*b*, 3*c* and FIG. 4. The precise orientation of the two-wire insulated conductor 32 relative to the molded body member 52 is not critical to the present invention. The configuration, where the two-wire conductor 32 extends from two separate sides of the molded insulating body member 52, prevents congestion around each receptacle 50 and requires the minimum length of conductor wire 32 between two spaced receptacles 50.

A tapered pin of a die mold is inserted into the flanged end 20 of each female connector member 10 with connected conductor wires 30 attached thereto. After injection of the molten thermoplastic material and solidification of the material, the mold and accompanying pins are removed to produce the molded female receptacle assembly 50 shown in partial cut away views in FIGS. 3*b*, 3*c* and FIG. 4. The body member 52 is produced with a pair of generally rectangular apertures 62 with inwardly tapering sides 64. Each aperture 62 is positioned in register with the U-shaped section 12 of a connector member 10 contained therein, thereby aligning an insertion slot 17 with each aperture 62. The insulated conductor wire 32 adjacent the connector members 10 is also encased in the body member 52 and protrudes from opposite sides 58 of the body member 52, near the second end 56 thereof, for connection to additional receptacle assemblies 50. Although the insulated conductor wire 32 may protrude from two adjacent sides 58 of the body member 52, protrusion from opposite sides 58 is preferred.

Figure 7:
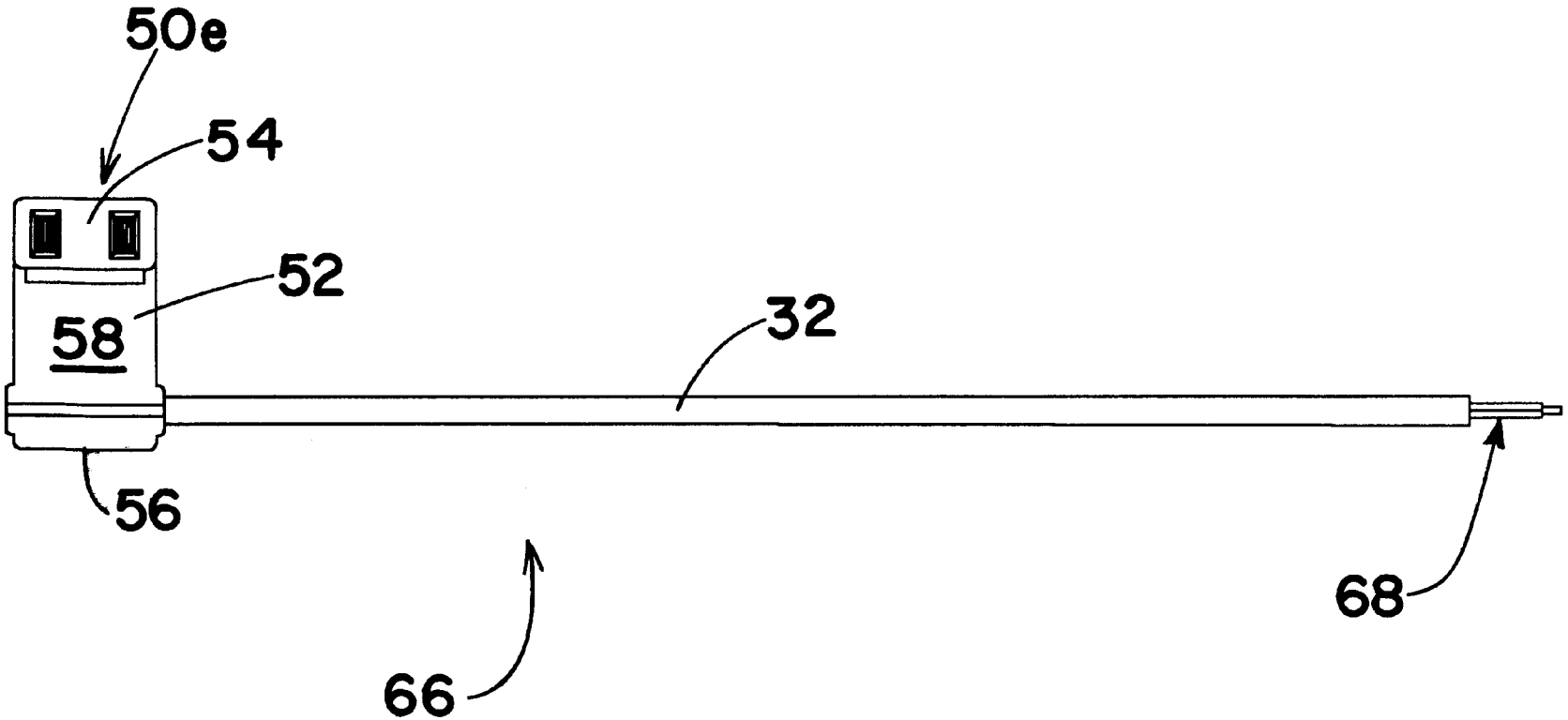
FIG. 7 is a plan view of one embodiment of the power cord assembly of the present invention.

FIG. 5 shows the embodiment of the invention where the receptacle body member first end 54 is oriented at a 135 degree angle relative to the second end 56. This orientation requires less bending of the portion of the female connector member 10 containing the pairs of crimping arm members 24, 26 relative to the U shaped section 12. FIG. 6 shows the embodiment of the invention where the receptacle body member first end 54 is oriented at a 180 degree angle relative to the second end 56. The female connector member 10 of FIG. 1 requires no bending in this embodiment of the invention, FIG. 7 shows the power cord assembly 66 of the present invention. The cord assembly 66 includes an insulated two-wire conductor 32 with an electrical connection means 68 at one end. The electrical connection means 68 may be simply the two-wire conductor 32 with the insulated covering 30 removed, leaving the conductor wire members 28 for connection to suitable power supply terminals (not shown). Alternatively, the electrical connection means 68 may be a male plug end member 68 with a plug blade connected to each conductor wire 28. The receptacle assembly 50*e*, located at the end of the cord assembly 66 opposite the electrical connector means 68, has the two-wire conductor 32 entering from one side only. This receptacle assembly 50*e* has a single conductor wire 28 fastened to each female connector member 10 therein, thereby terminating the cord assembly 66.

Figure 8:
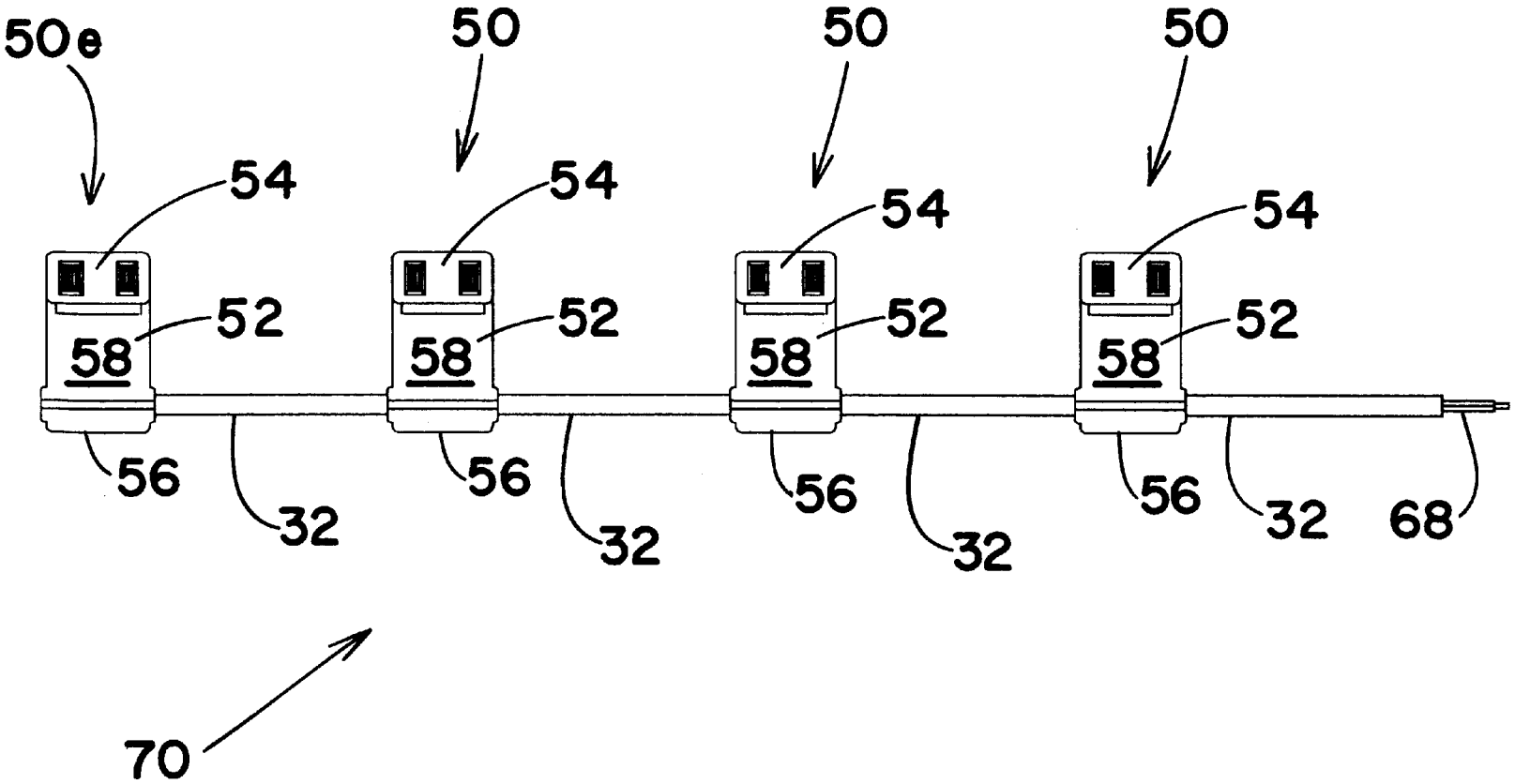
FIG. 8 is a plan view of one embodiment of the daisy chain power cord assembly of the present invention.

Referring to FIG. 8, the daisy chain power cord assembly 70 of the present invention is shown. The daisy chain cord assembly 70 includes an insulated two-wire conductor 32 fitted with an electrical connector means, such as a male plug end member 68, at one end. A plurality of molded female receptacle assemblies 50 are each electrically connected in parallel to the two-wire conductor 32 at selected spaced intervals, as described above. The two-wire conductor 32 extends from opposite sides 58 of each receptacle assembly 50, avoiding congestion of the wire conductor 32 around the receptacle assemblies 50, and requiring a minimum of wire conductor 32 between receptacles 50. The receptacle assembly 50*e*, located at the end of the daisy chain cord assembly 70, again has the two-wire conductor 32 entering from one side only. This receptacle assembly 50*e* has a single conductor wire 28 fastened to each female connector member 10 therein, thereby terminating the daisy chain cord assembly 70.

The cord assemblies 66, 70 of FIGS. 7 and 8 employ the embodiment of the receptacle assemblies 50 with first and second ends 54, 56 mutually oriented at a 90 degree angle. The other alternative embodiments of the receptacle assembly 50 shown in FIGS. 5 and 6, with alternative orientations of the receptacle body member first and second ends, can be incorporated into the cord assemblies 66, 70 of FIG. 7 and 8 with equal results.

Figure 9A:
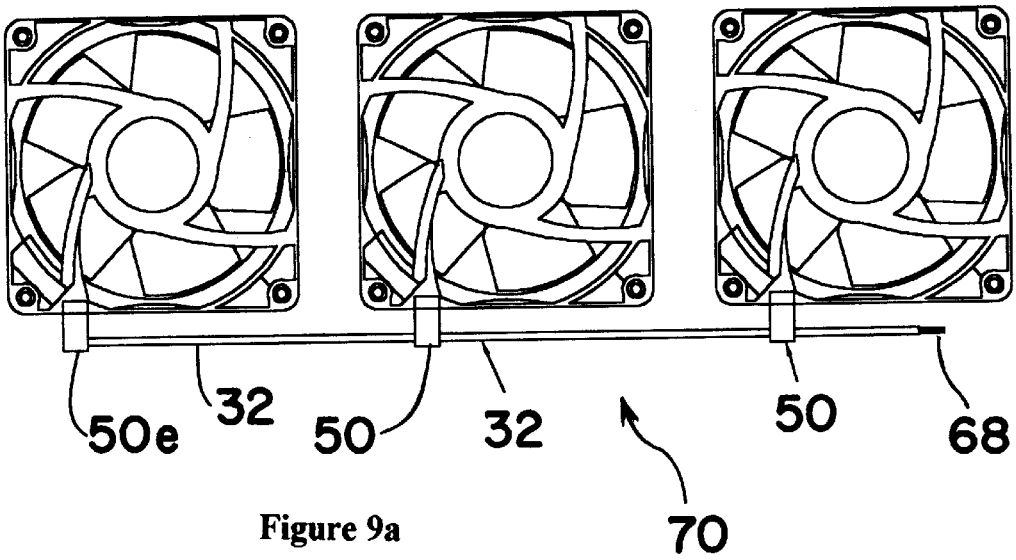
FIG. 9*a* is a perspective view of the daisy chain power cord assembly of the present invention powering a number of electrical fans.
Figure 9B:
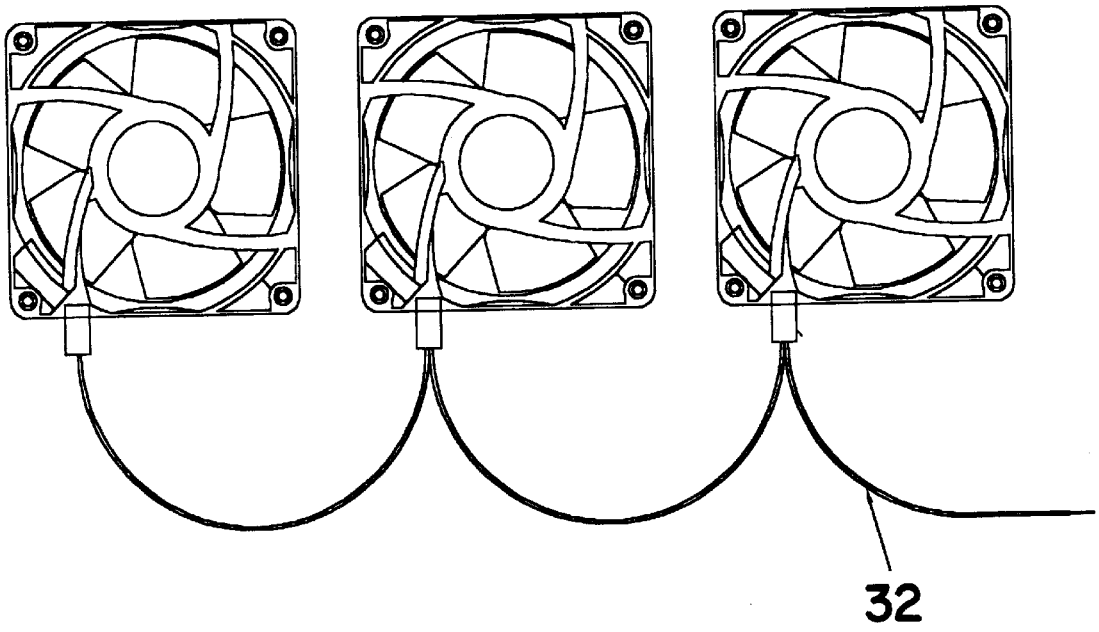
FIG. 9*b* is a perspective view of an ordinary daisy chain power cord assembly powering a number of electrical fans.

FIGS. 9*a* and 9*b* compare the daisy chain power cord assembly 70 of the present invention to a conventional daisy chain power cord assembly, where both are used to power a number of fans. The cord assembly 70 of FIG. 9*a* requires much shorter lengths of electrical conductor wire to span the distance between selected fans powered by a single power cord. The conventional power cord assembly of FIG. 9*b*, with electrical conductor wire extending from the receptacle end opposite the aperture end, produces greater congestion around each receptacle and requires greater lengths of electrical conductor wire to span the distance between selected fans powered by a single power cord.

While the invention has been particularly shown and described with reference to a preferred embodiment thereof, it will be understood by those skilled in the art that various changes in form and details may be made therein without departing from the spirit and scope of the invention.

I claim:

1. A female receptacle assembly for attachment to a two-wire insulated conductor comprising;

(a) first and second female connector members of electrical conductor material, each connector member including a first end with an insertion slot and a second end with crimping means for attachment to a conductor wire of the two-wire conductor, said insertion slot comprising a U-shaped section with first and second ends with vertical sides and a transverse bottom section, with said U-shaped section first end vertical sides flanged outwardly to enlarge said connector U-shaped section first end, said crimping means comprising a linear section having first and second pairs of crimping arm members, said first pair of arm members adapted for crimping on a double conductor wire of the two-wire conductor, and said second pair of arm members adapted for crimping on a double insulated conductor wire of the two-wire conductor; and (b) a body member of insulating material encasing said first and second female connector members attached to a two-wire conductor, said body member having first and second ends and four sides, with said body member first end having a pair of rectangular apertures, each in register with an insertion slot of a female connector member embedded within said body member, the two-wire conductor extending from two sides of said generally rectangular body member near said second end thereof.

2. The female receptacle assembly according to claim 1, wherein said body member first and second ends are mutually oriented at 180 degrees.

3. The female receptacle assembly according to claim 1, wherein said body member first and second ends are mutually oriented at 135 degrees.

4. The female receptacle assembly according to claim 1, wherein said body member first and second ends are mutually oriented at 90 degrees.

5. The female receptacle assembly according to claim 1, wherein said body member pair of rectangular apertures in register with said female connector members has inwardly tapering sides.

6. The female receptacle assembly according to claim 1, wherein the two-wire connector extends from two opposite sides of said body member near said second end thereof.

7. The female receptacle assembly according to claim 1, wherein said body member of insulating material is fabricated by injection molding.

8. The female receptacle assembly according to claim 1, wherein said body member of insulating material is mechanically assembled from pre-molded sections.

9. The female receptacle assembly according to claim 1, wherein said body member of insulating material is fabricated by ultrasonic welding of pre-molded sections.

10. A power cord assembly comprising;

(a) a two-wire insulated conductor of selected length with electrical connection means at one end; and (b) a female receptacle assembly electrically attached to said two-wire insulated conductor at a second end thereof, said female receptacle assembly comprising;

(i) first and second female connector members of electrical conductor material, each connector member including a first end with an insertion slot and a second end with crimping means for attachment to a conductor wire of said the two-wire conductor, said insertion slot comprising a U-shaped section with first and second ends with vertical sides and a transverse bottom section, with said U-shaped section first end vertical sides flanged outwardly to enlarge said connector U-shaped section first end, said crimping means comprising a linear section having first and second pairs of crimping arm members, said first pair of arm members adapted for crimping on a double conductor wire of the two-wire conductor, and said second pair of arm members adapted for crimping on a double insulated conductor wire of the two-wire conductor; and (ii) a body member of insulating material encasing said first and second female connector members attached to said two-wire conductor, said body member having first and second ends and four sides, with said body member first end having a pair of rectangular apertures, each in register with an insertion slot of a female connector member embedded within said body member, said two-wire conductor extending from one side of said generally rectangular body member near said second end thereof.

11. The power cord assembly according to claim 10, further comprising, (c) at least one additional said female receptacle assembly connected in parallel to said two-wire conductor at selected spaced intervals with said two-wire conductor extending from two sides of said at least one additional female receptacle body member near a second end thereof.

12. The power cord assembly according to claim 10, wherein said electrical connection means comprises a male plug member with blades electrically connected to said two-wire conductor.

13. The power cord assembly according to claim 10, wherein said body member first and second ends are mutually oriented at 180 degrees.

14. The power cord assembly according to claim 10, wherein said body member first and second ends are mutually oriented at 135 degrees.

15. The power cord assembly according to claim 10, wherein said body member first and second ends are mutually oriented at 90 degrees.

16. The power cord assembly according to claim 10, wherein said body member pair of rectangular apertures in register with said female connector members has inwardly tapering sides.

17. The power cord assembly according to claim 11, wherein said two-wire connector extends from two opposite sides of said at least one additional female receptacle body member near said second end thereof.

18. A daisy chain power cord assembly comprising;

(a) a two-wire insulated conductor of selected length with electrical connection means at one end;

(b) a female receptacle assembly electrically attached to said two-wire insulated conductor at a second end thereof, said female receptacle assembly comprising;

(i) first and second female connector members of electrical conductor material, each connector member including a first end with an insertion slot and a second end with crimping means for attachment to a conductor wire of said the two-wire conductor, said insertion slot comprising a U-shaped section with first and second ends with vertical sides and a transverse bottom section, with said U-shaped section first end vertical sides flanged outwardly to enlarge said connector U-shaped section first end, said crimping means comprising a linear section having first and second pairs of crimping arm members, said first pair of arm members adapted for crimping on a double conductor wire of the two-wire conductor, and said second pair of arm members adapted for crimping on a double insulated conductor wire of the two-wire conductor; and (ii) a body member of insulating material encasing said first and second female connector members attached to said two-wire conductor, said body member having first and second ends and four sides, with said body member first end having a pair of rectangular apertures, each in register with an insertion slot of a female connector member embedded within said body member, said two-wire conductor extending from one side of said generally rectangular body member near said second end thereof; and (c) at least one additional said female receptacle assembly connected in parallel to said two-wire conductor at selected spaced intervals, with said two-wire conductor extending from two opposite sides of said at least one additional female receptacle body member near a second end thereof.

19. The daisy chain power cord assembly according to claim 18, wherein said electrical connection means comprises a male plug member with blades electrically connected to said two-wire conductor.

* * * * *